US011897028B2

(12) United States Patent
Han

(10) Patent No.: US 11,897,028 B2
(45) Date of Patent: Feb. 13, 2024

(54) CONTROLLED NOZZLE COOLING (CNC) CASTING

(71) Applicant: Qingyou Han, West Lafayette, IN (US)

(72) Inventor: Qingyou Han, West Lafayette, IN (US)

( * ) Notice: Subject to any disclaimer, the term of this patent is extended or adjusted under 35 U.S.C. 154(b) by 298 days.

(21) Appl. No.: 16/992,245

(22) Filed: Aug. 13, 2020

(65) Prior Publication Data

US 2022/0048104 A1 Feb. 17, 2022

(51) Int. Cl.

| | |
|---|---|
| ***B22C 9/02*** | (2006.01) |
| ***B22D 17/22*** | (2006.01) |
| ***B22D 27/04*** | (2006.01) |
| ***B22D 17/20*** | (2006.01) |
| ***B22C 9/06*** | (2006.01) |

(52) U.S. Cl.

CPC ..... *B22D 17/2038* (2013.01); *B22C 9/02* (2013.01); *B22C 9/061* (2013.01); *B22C 9/068* (2013.01); *B22D 17/2023* (2013.01); *B22D 17/2218* (2013.01); *B22D 27/04* (2013.01)

(58) Field of Classification Search

CPC ..... B22C 9/02; B22D 17/2218; B22D 27/04; B22D 27/045; B29C 45/73

See application file for complete search history.

(56) References Cited

U.S. PATENT DOCUMENTS

2009/0065170 A1* 3/2009 Vais ..... B22D 17/32 164/458

FOREIGN PATENT DOCUMENTS

| | | | | |
|---|---|---|---|---|
| CN | 106001418 A | * | 10/2016 | ..... B22C 9/02 |
| GB | 2196281 A | * | 4/1988 | ..... B22D 27/045 |
| JP | 2003103342 A | * | 4/2003 | |
| WO | WO-2013085401 A1 | * | 6/2013 | ..... B22C 9/02 |

* cited by examiner

*Primary Examiner* — Kevin E Yoon

(57) ABSTRACT

A process for the casting of metals and their alloys includes the steps of providing at least a mold equipped with a plurality of cooling nozzles, making a layer of coolant permeable materials covering the nozzles and maintaining the materials at desired temperatures, delivering a molten metal into the mold, supplying predetermined amount of coolant to each nozzles to contact the casting at desired rate, time, and duration to achieve an acceptable level of progressive solidification from the distal end of the casting towards the riser until the casting has reached desired temperatures.

9 Claims, 9 Drawing Sheets

CONTROLLED NOZZLE COOLING (CNC) CASTING

GRANT STATEMENT

None.

FIELD OF THE INVENTION

The present invention relates to the casting of metals, more specifically, to a novel method of controlled nozzle cooling (CNC) casting using arrays of nozzle embedded in the casting molds.

BACKGROUND OF THE INVENTION

A conventional casting process involves pouring a molten metal in a mold and solidifying the molten metal to produce solid products, i.e., castings. The microstructure and the resultant mechanical properties of the casting are controlled by the heat removal rate from the molten metal by the molds. Fast heat removal causes fast cooling of the molten metal, resulting in castings of fine microstructure and improved mechanical properties [1-2].

The cooling rate of the molten metal during its solidification process in a mold cavity is affected by the thermal diffusivity of the molding materials and the air gap between the mold and the casting [3]. This air gap is formed when the surface of the casting pulls away from the mold surface due to the contraction of the metal on cooling.

Metals or graphite have high thermal diffusivity. These materials are used for making molds for high pressure die casting processes and other permanent mold casting processes, and are excellent in solidifying the molten metal quickly to produce castings of fine microstructure, such as small primary phase grains, dendrite arm spacing (DAS), and fine eutectic phase particles. However, the molten metal has to be forced to flow rapidly to fill the mold cavity before it freezes. Rapid mold filling is always turbulent which causes the formation of defects such as entrapped oxides and gases [4]. Furthermore, metal molds are expensive. Turbulent flow results in severe erosion and soldering damage to metal molds [5].

Sands have a much lower thermal diffusivity than metals and graphite. Mold filling of molten metal in a sand mold cavity can be much smoother than that in a metal mold cavity. However, cooling rates of the molten metal in a sand mold cavity are low. Gap formation further slows down the cooling rate after the fraction solid of the dendrites at the surface of the casting reaches a certain critical value, typically 0.2-0.3 [3]. In cast alloys, most of the eutectic phases and other secondary phase particles are usually formed at a fraction solid much larger than 0.2 [6]. As a result, castings made using sand molds contain coarse eutectic structures, which negatively affect the ductility of the castings [1-2].

U.S. Pat. No. 7,216,691 to Grassi et al. discloses an ablation casting technology which uses a soluble binder for making sand molds and nozzles outside of the molds for spraying a liquid solvent over the molds to dissolve the soluble binder, ablating away the molds and cooling the solidifying casting directly using the liquid solvent. Thus, the formation of an air gap at the casting-mold interface is avoided. This innovative technology allows for a smooth molding filling of molten metal in a sand mold cavity but uses a liquid solvent to rapidly cool the casting to achieve cooling rates higher than those in metal molds. Fine solidification microstructure especially that of the eutectic phases and the secondary phases are obtained. Castings made using this technology have much better mechanical properties than those made using the conventional sand casting process [1-2].

However, there are still a few issues associated with this innovative ablation casting technology. A binder that is rapidly dissolved into a solvent has to be used to hold together the sand particles. As a result, a large variety of sand/binder combinations cannot be used for making sand molds using the ablation casting process. Semi-permanent molds and permanent molds are not suitable for the ablation casting process because these molds cannot be dissolved in a solvent quickly enough. Furthermore, molds contain a soluble binder has to be cured at longer duration than the conventional sand molds using clay as the binder, which extends the mold making cycle. Also the technology uses flask-less molds to allow for the collapse of the molds because the spray nozzles are located outside the molds and have to travel over the molds. Flask-less molds are usually small but have to be thicker than 70 mm. To ablate away a thick mold from the casting within short time duration, a large amount of liquid solvent is required. This may limit the conditions under which the cooling liquid is allowed to impinge on the surfaces of the solidifying casting. An early impingement of the cooling liquid with its full impacting force of the spraying jet may cause a number of problems including leakage of molten metal from the molds, damaged surfaces of the casting, and distortion of the solidified components. Often, the delivery of the cooling liquid has to be delayed to allow for the formation of a relatively solid skin of the casting before it can withstand the full impact of the spraying jet. Indeed, results shown in the patent to Gassi et al. suggest that DAS of the primary phase in a casting made using the ablation casting process is not changed much compared to that using the conventional sand casting process. This is an indication that water cooling is applied at fairly late stage of the solidification process in the casting, i.e., the casting is cooled in sand molds for its early stage of solidification and then cooled afterwards with the liquid solvent. Fast cooling using the spraying liquid is not fully used during the entire solidification process of the cast metal.

Therefore, there is a need for developing a novel casting process that has the advantage of smooth mold filling of sand molds and rapid solidification of metal molds while also using conventional binders for making the sand molds in flasks. The rapid solidification is achieved by contacting the solidifying metal with a coolant from nozzles embedded in the molds rather than with a solvent sprayed from nozzles traveling over the mold as taught by the U.S. Pat. No. 7,216,691 to Grassi et al.

There is also a need for developing a novel casting process that is suitable for casting processes using semi-permanent molds or metal molds.

There is also a need for developing a process that is capable of making a thin-walled and extremely large casting.

Furthermore, there is a need for developing a process and related apparatus that are retrofittable to existing production lines for making castings.

SUMMARY OF THE INVENTION

The invention provides a controlled nozzle cooling casting process using a plurality of nozzles embedded in molds. The process includes the steps of providing at least a mold embedded with a plurality of cooling nozzles, making a layer of sand or coating to prevent direct contact of the nozzle with the molten metal, introducing a molten alloy into the mold cavity, and delivering a predetermined amount of coolant through each nozzle at predetermined rate, time, and duration to cool the casting as needed to achieve an acceptable level of progressive solidification from the distal end of the casting towards the riser or downsprue until the casting has reached desired temperatures.

In an embodiment of the present invention, a process for reducing the cooling time of a solidifying metal and increasing casting productivity is provided. The process includes the steps of providing at least a mold embedded with a plurality of cooling nozzles, and delivering a predetermined amount of coolant through each nozzle at predetermined rate, time, and duration to eliminate the air gap that usually exists at the interface between the mold and the casting. Eliminating the air gap at the mold-casting interface greatly reduces the cooling time to solidify a casting and increases casting productivity.

In another embodiment of the present invention, a process for reducing the internal defects and increasing the mechanical properties of a casting is provided. The process includes the steps of providing at least a mold embedded with a plurality of cooling nozzles, and delivering a predetermined amount of coolant through each nozzle at predetermined rate, time, and duration to cool the casting as needed just to achieve an acceptable level of progressive solidification from the distal end of the casting towards the riser or downsprue. The cooling of the casting using a coolant produces a fine solidification microstructure and improved mechanical properties.

In yet another embodiment of the present invention, a process for using less or inexpensive molding materials for making a high quality casting is provided. The process includes the steps of providing a permanent mold lined with a layer of an expendable sand liner, embedding a plurality of cooling nozzles in the molds, introducing a molten alloy into the mold cavity, and delivering a predetermined amount of coolant through each nozzle at predetermined rate, time, and duration to contact the casting to achieve a progressive solidification from the distal end of the casting towards the riser or downsprue until the casting has reached desired temperatures. The use of an expendable sand liner in a permanent mold eliminates the need for using a semi-permanent mold such as a graphite mold for making high quality castings.

In yet another embodiment of the present invention, a process for making a thin-walled large casting is provided. The process includes the steps of providing a permanent mold lined with a layer of an expendable sand liner, embedding a plurality of cooling nozzles in the molds, heating up the metal mold supported sand liner to high temperatures, supplying a molten alloy into the mold cavity, and delivering a predetermined amount of coolant through each nozzle at predetermined rate, time, and duration to contact the casting to achieve a progressive solidification from the distal end of the casting towards the riser or downsprue until the casting has reached desired temperatures. The mold at high temperatures allows for a smooth mold filling of a thin-wall large casting. The controlled nozzle cooling ensures progressive solidification in the casting to achieve the desired performance requirements.

In yet another embodiment of the present invention, a process is provided for making a high-quality casting that can retrofit into existing casting production lines. The process includes the steps of providing molds with a plurality of cavities for cooling nozzles that are molded or machined, embedding nozzles that are connected to the coolant delivery system in the molds at the pouring station before metal pouring, introducing a molten metal into the mold cavity, delivering a predetermined amount of coolant through each nozzle at predetermined rate, time, and duration to contact the casting to achieve a progressive solidification from the distal end of the casting towards the riser or downsprue until the casting has reached desired temperatures, and finally removing the nozzle cooling system out of the mold.

DETAILED DESCRIPTION OF THE INVENTION

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety.

The invention teaches a controlled cooling casting process using an array of nozzles embedded in molds that delivers a desired amount of selected coolant at desired times to contact the surfaces of a casting to ensure progressive solidification from the distal end of a casting to the riser.

Figure 1A:
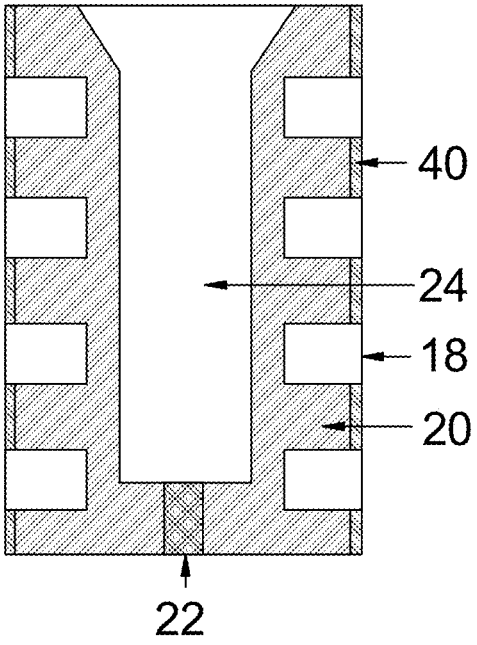
FIGS. 1A and 1B are schematic views of a layout of one embodiment of the present invention.
Figure 1B:
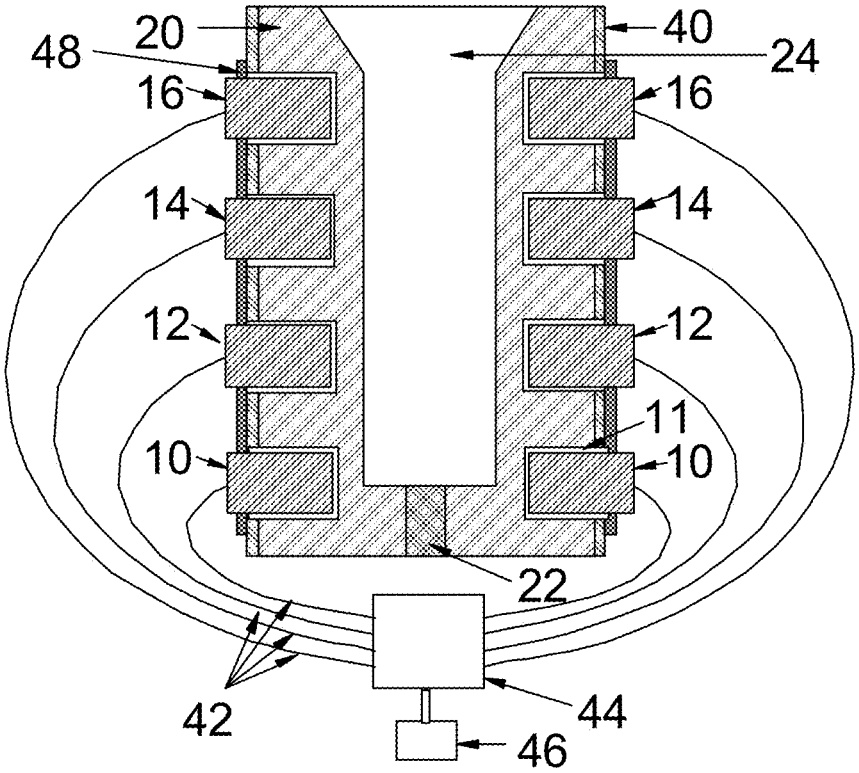

FIGS. 1A and 1B illustrate a method and an apparatus of one embodiment of the present invention of CNC casting. Sand mold 20 is made with or without a flask 40. The mold 20, which is permeable to liquid or gases, is composed of an aggregate and a binder that are conventionally used for making sand molds. The mold 20 can be made using a mold making machine, sand blower, 3D printing, and etc. The cavity 24 in the mold 20 is used for making a casting. A plurality of cavities 18 are made for hosting the nozzles, 10, 12, 14, and 16 that are to be embedded in the sand mold 20. Cavities 18 are molded using a pattern or are machined. The cavity 18 can also be a through hole so that the nozzle can be placed in the mold flush with the surface of the cavity 24. Conventional coatings can be applied on the surface of the mold cavity 24, especially if the tip surface of the nozzle 10, 12, 14, or 16 is flush with the surface of the mold cavity 24 if the cavity 18 is a through hole.

Having made the mold 20, nozzles 10, 12, 14, and 16 mounted on a rigid fixture 48 are placed manually or using a robot in the cavities 18 before molten metal is poured in the mold cavity 24. The fixture 48 can also be used to lock the molds in place to prevent the molds from opening and the resultant metal leakage from the molds due to the static pressure that the molten metal in cavity 24 applies on the mold 20. A gap 11 is designed to allow the used coolant and the resultant gases to escape from the tip of the nozzle 10, 12, 14, or 16. A number of venting 22 (only one is shown in FIG. 1) is also recommended for releasing the gases in the mold cavity 24 and molding materials of the mold 20. The nozzles 10, 12, 14, and 16 are connected to a controller 44 using conduit 42. Coolant is provided from coolant supply 46, regulated by the controller 44, and delivered to each nozzle. The controller 44 controls the delivery of a desired amount of coolant to each nozzle at predetermined time and rate. It is important to note that the coolant delivery system consists of nozzles 10, 12, 14, 16 and their conduit 42, the fixture 48, the controller 44, and the coolant supply 46. The mold 20 and its flask 40 can be prepared in a conventional casting production line. The coolant delivery system can be associated to the molds before pouring molten metal into the mold cavity 24 and removed out of the mold 20 after the casting has been cooled to desired temperatures. Thus, only one or a limited number of coolant delivery systems are needed for an entire conventional casting production line for the mass production of castings.

Figure 2A:
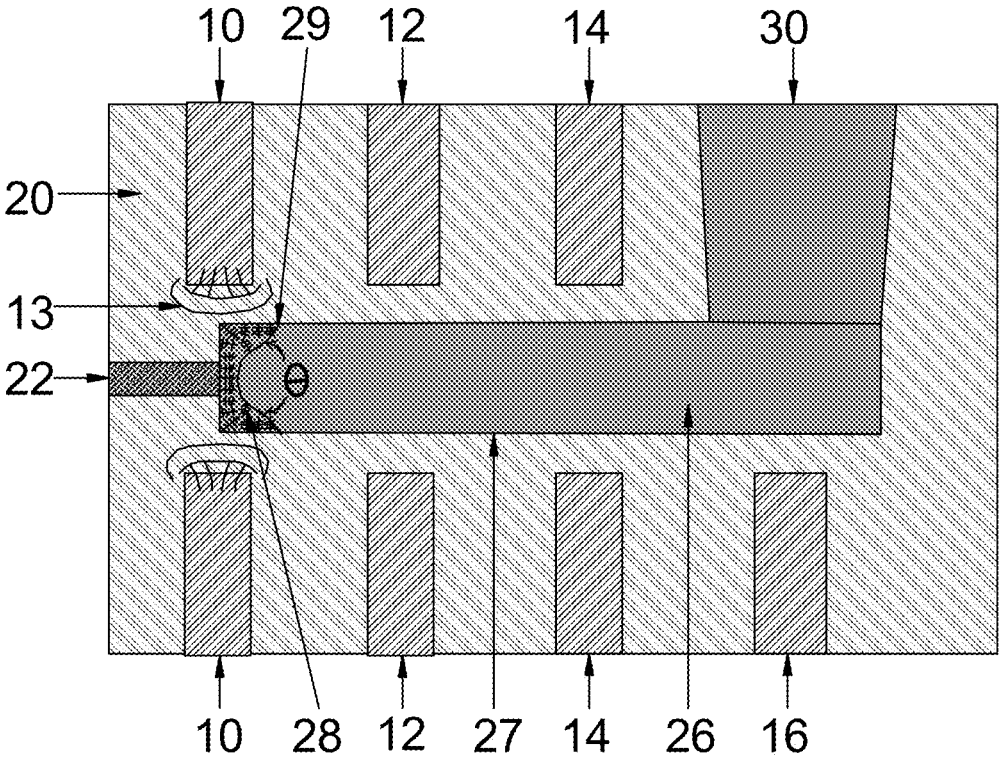
FIGS. 2A and 2B are schematic views of a layout of one embodiment of the present invention.
Figure 2B:
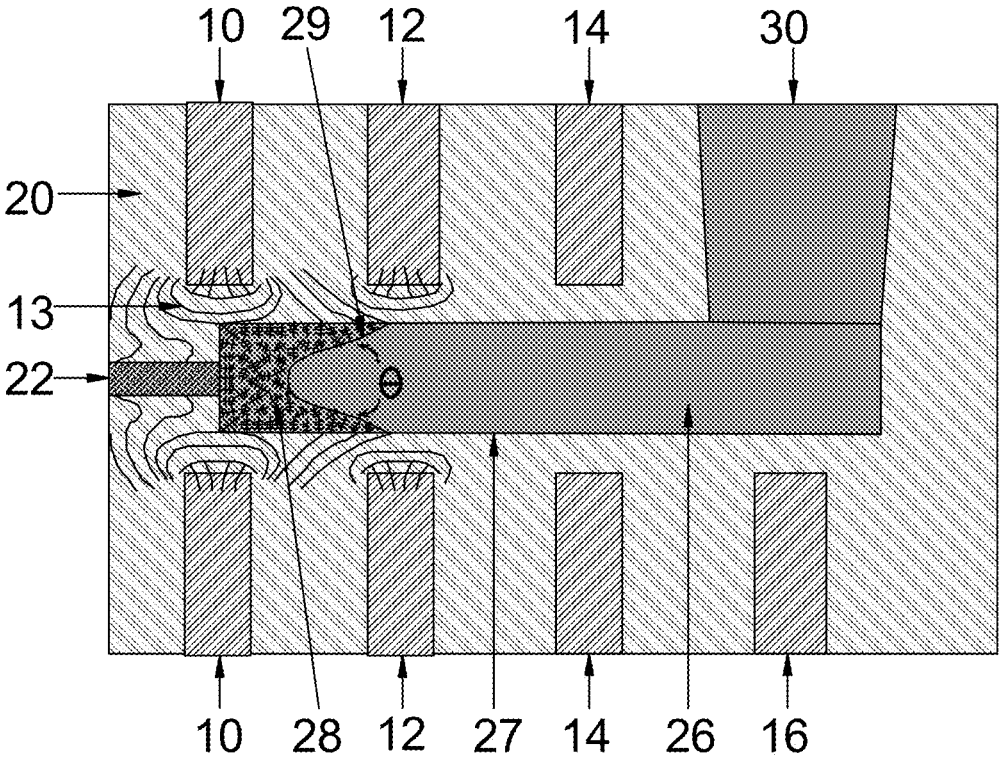

The sequence of coolant delivery to each array of nozzles is shown in FIGS. 2A and 2B. After molten metal fills the mold cavity, a predetermined amount of coolant is delivered to the first array of nozzles 10. As the coolant is released from the nozzle 10 and percolates through the sand to the molten metal of the casting 26 in a pattern shown as 13 in FIG. 2A, solid dendrites 28 start forming from the molten metal near the distal end of the casting 26 due to the combined cooling of the mold 20 and the coolant. A freezing front 29 thus forms near the distal end of the casting 26 and moves gradually towards the riser 30. When the freezing front 29 moves close to the second array of nozzles 12, coolant starts to be delivered to nozzles 12 shown in FIG. 2B. As the freezing front 29 moves further towards the riser 30, nozzles 14 and 16 will be actuated and nozzles 10 and 12 will be gradually switched off as needed. Any air gap 27 at the casting/mold interface that forms due to the contraction of the casting 26 is filled with the coolant. The delivery of coolant is such that the angle, θ, is larger than the value that is required for an adequate feeding of liquid metal to the shrinkage in the mushy zone at the left side of the freezing front 29. The coolant discussed in the present invention can be a liquid such as water, mineral oil, and liquid nitrogen, or gases such as $CO_2$, compressed air, moisture, $N_2$ or helium. In fact, liquids and gases that are conventionally used in the casting industry as coolant can be used as coolants in the present invention.

Figure 3:
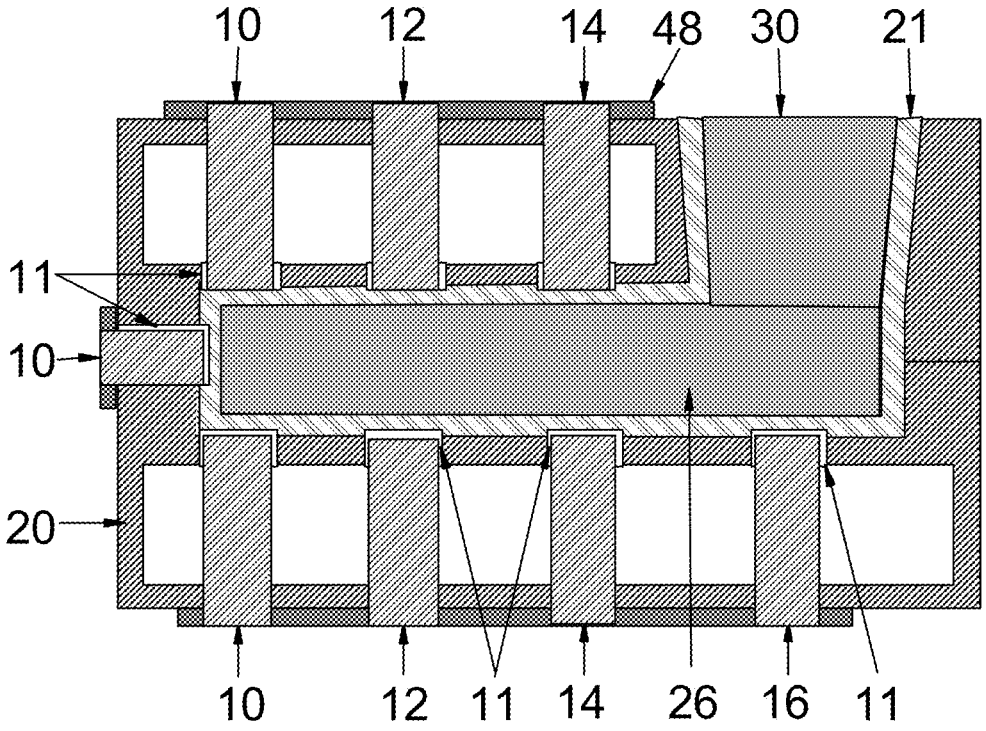
FIG. 3 is a schematic view of a layout of one embodiment of the present invention using a sand liner.

FIG. 3 illustrates a method and an apparatus of another embodiment of the present invention of CNC casting using molds with a sand liner. Since sand is used only for the purpose of a smooth mold filling and the cooling of the casting is controlled by using a coolant from nozzles, the thickness of the sand layer can be significantly reduced so that less sand and binder are needed for making molds. FIG. 3 shows an expendable sand liner 21 in metal molds 20. The sand liner 12 can be made using sand blower. Nozzles 10, 12, 14, 16 are fixed on a rigid fixture 48 and are embedded in the mold 20 and the liner 21 during or after the liner 21 is made. The sand liner 21 contacts the molten metal 26 and 30 during mold filling. The nozzles 10, 12, 14, and 16 deliver the predetermined amount of coolant at predetermined times to the locations where rapid cooling is required. The coolant delivered from the nozzles 10, 12, 14, or 16, penetrates the permeable sand liner and contacts the surfaces of the casting 26 to maintain a progressive solidification from the distal end of the casting 26 to the riser 30. The gap 11 and other venting system (not shown in FIG. 3) allow the used coolant and resultant gases to escape from the cooling zone. The sand liner 21 is expendable and used for only once. The metal mold 20 supporting the sand liner 21 can be used for many times. Since a new sand liner 21 needs to be made for each casting 26, the dimensional accuracy of the casting 26 is ensured regardless of deformation/distortion that may occur in the metal molds 20.

Figure 4:
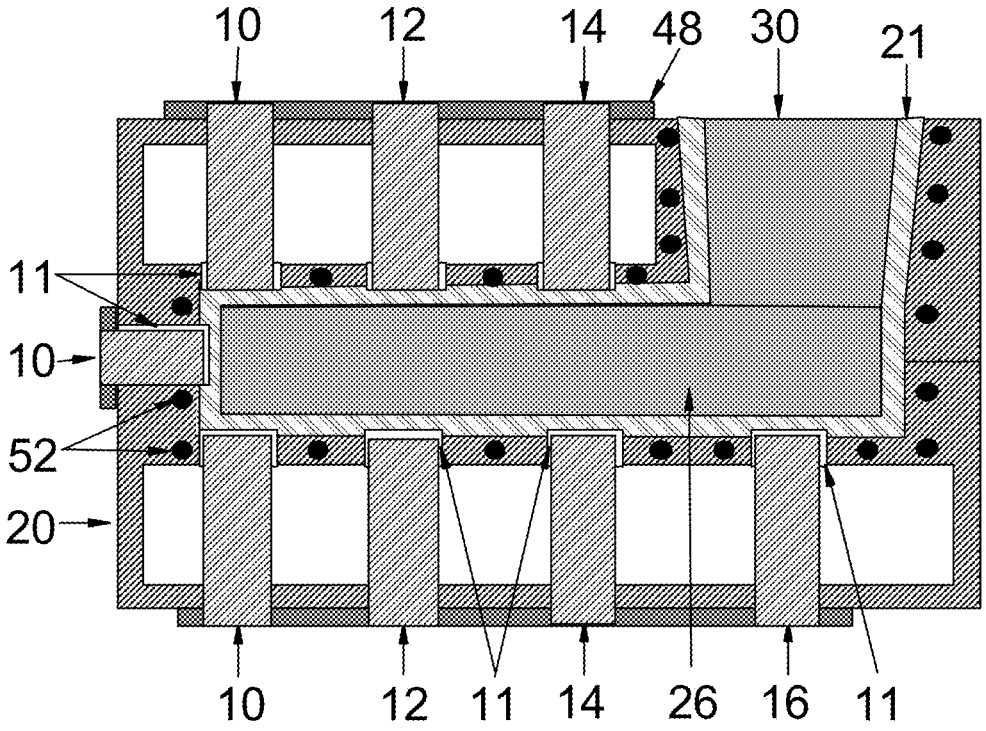
FIG. 4 is a schematic view of a layout of one embodiment of the present invention using heaters to heat a sand liner.

FIG. 4 illustrates a method and an apparatus of yet another embodiment of the present invention of CNC casting using a liner in metal molds. The liner 21 can be made of sand, insulation materials, or thermal barrier materials. By using a thin liner 21 and a heating source 52 shown in FIG. 4, the liner 21 can be quickly heated up to elevated temperatures before or after the molds 20 are closed and in waiting to receive molten metal. To speed up the heating of the liner 21, external heating sources such as infrared heating (not shown in FIG. 4) can be used to assist the heat source 52 in heating up the cavity side of the liner 21 after the cope (top mold) or drag (the bottom mold) are made but before they are closed. Moisture and gases in the liner 21 can be better removed at high temperatures for producing castings 26 with improved internal integrity. Molten metal 26 and 30 can be poured slowly to avoid oxide formation and entrapment during mold filling. More importantly, an extremely large casting 26 can be made using a metal mold 20 supported thin liner 21 which is heated to close to the liquidus temperature of the casting metal 26. When the sand liner 21 is at the liquidus temperature of the casting metal 26, heat loss from the molten metal 26 during mold filling is minimized so that the molten metal 26 can be poured into the mold cavity very slowly and flow easily to fill a thin mold cavity with a great length. Theoretically, there is no limit to the size of a thin-wall casting 26 to be made using the present invention if the liner 21, supported by rigid molds 20, is held at the same temperature as the cast molten metal 26. A controlled delivery of coolant through nozzles 10, 12, 14, and 16 to the surfaces of casting 26 ensures progressive solidification from the distal end of the casting 26 to the riser 30. The benefits using the present invention shown in FIGS. 3 and 4 include 1) reduced use of sand and binder, 2) smooth filling of the mold cavity, and 3) the capability of making large and thin-wall castings with high internal integrity and mechanical properties.

Figure 5:
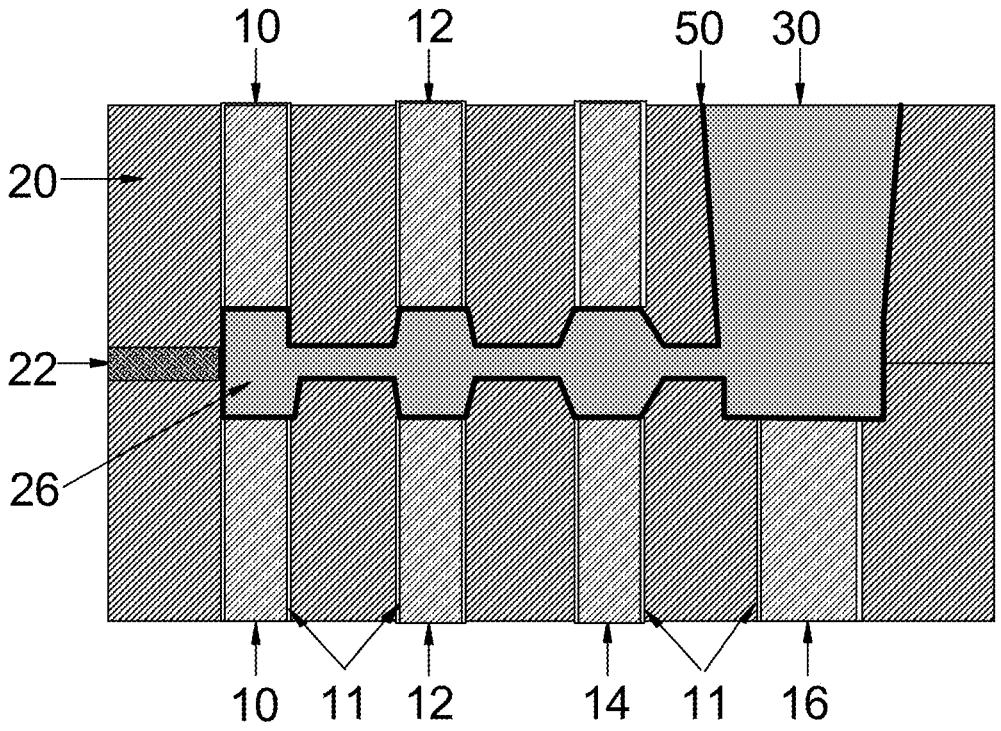
FIG. 5 is a schematic side view of a layout of one embodiment of the present invention.

FIG. 5 illustrates a method and an apparatus of yet another embodiment of the present invention of CNC casting using semi permanent molds or permanent molds. Nozzles 10, 12, 14, and 16 are embedded in the molds 20. A layer of coating 50, which is permeable to the coolant to be used, is applied on the internal surfaces of the molds 20. Controlled delivery of the coolant from nozzles 10, 12, 14, and 16 through the coolant permeable coating 50 to the surfaces of the casting 26 ensures progressive solidification from the distal end of the casting 26 to the riser 30. Gaps 11 and venting plugs 22 allow the used coolant and resultant gases to be released. The benefits of using the present invention shown in FIG. 5 include 1) reduced solidification time of the casting, or reduced production cycle for each casting, and 2) improved internal integrity and mechanical properties of the casting.

The invention further provides examples of the present invention of CNC casting. The examples provided below are meant merely to exemplify several embodiments, and should not be interpreted as limiting the scope of the claims, which are delimited only by the specification.

Example 1

Mold filling during sand mold casting can be relatively well controlled compared to that during high pressure die casting. However, the freezing rate is much lower in sand molds than that in metal molds because sand has a lower thermal diffusivity than metal. As a result, sand castings usually have coarse solidification microstructures and poor mechanical properties. Grassi et al tested making automotive steering knuckles of aluminum A356 alloy using a typical sand casting process and an ablation casting process [1-2]. They found that that the tensile strength, yield strength, and elongation in samples taken from the conventional sand casting were 228 MPa, 179 MPa, and 3.5 respectively. Using water as solvent in the ablation casting process, the tensile strength, yield strength, and elongation in samples taken from the casting were 325 MPa, 261 MPa, and 12.5 respectively, much higher than that in the sand casting. It is expected that castings made using the present invention of CNC casting as shown in FIGS. 1A and 1B using water as the coolant should have identical mechanical properties as those made using the ablation casting process. However, compared to the ablation casting process which has to use a soluble binder for making the sand molds, the present invention of CNC casting shown in FIGS. 1A and 1B can be used for aggregate mold using any conventional binder including clay/water, sodium silicate/water, resin, and oil. Thus, the present invention shown in FIG. 1 can retrofit in the existing sand casting production lines for mass production of castings.

Example 2

Figure 6A:
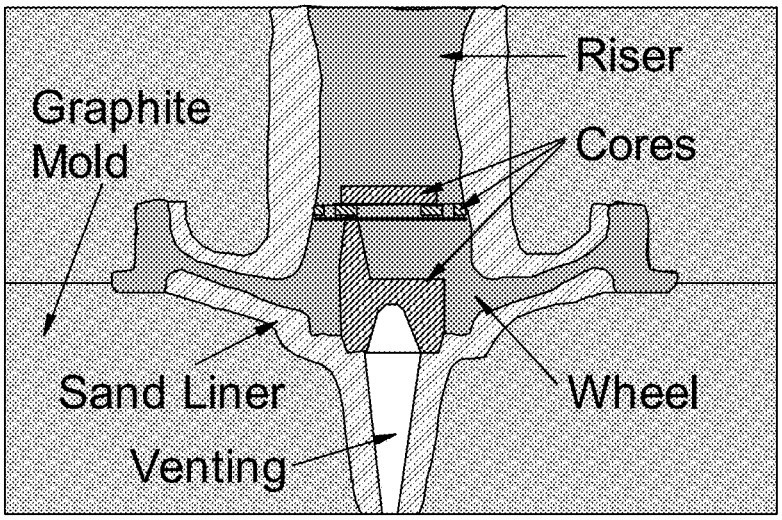
FIG. 6A is a schematic side view of a layout of a prior art of making a cast steel railway wheel.
Figure 6B:
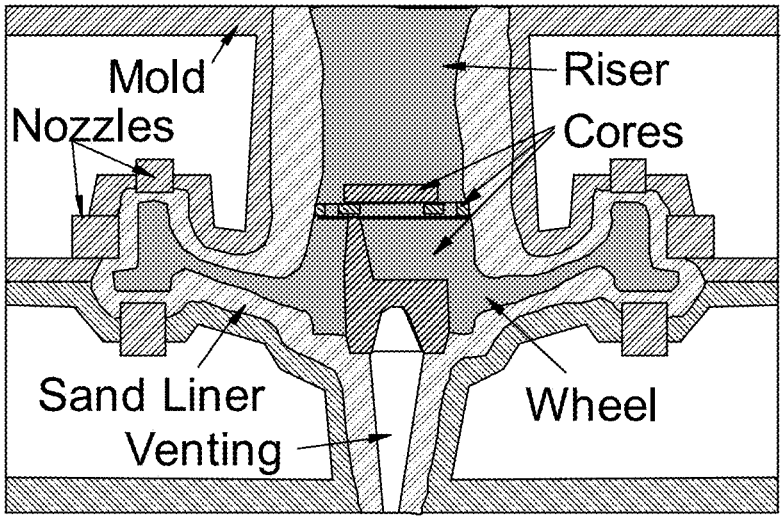
FIG. 6B is a schematic side view of a layout of one embodiment of the present invention on making a cast steel railway wheel.

Steel railway wheels were initially made using a sand mold with a metal ring to chill the tread of the wheel to encourage progressive solidification starting from the tread surface to the wheel hub [7]. Later, a graphite mold technology was developed [8]. Steel wheels produced using graphite molds are more consistent in quality than those made using sand molds. U.S. Pat. No. 3,302,919 to Beetle et al. describes a method of using a sand liner in graphite molds to make a cast steel railway wheel. As shown in FIG. 6A, part of the graphite mold is used for cooling the tread and rim of the wheel during solidification. The sand liner is used to slow down the cooling rate of the wheel plate, allowing a progressive solidification from the tread to the hub of the wheel [8]. However, the cost of using the graphite technology is much higher than using the sand mold technology for making cast steel railway wheels. It is expected that the present invention shown in FIG. 3 is capable of producing railway steel wheels without using expensive graphite molds. FIG. 6B is a schematic presentation for producing steel wheels using present invention. Metal molds are lined with a sand liner. Nozzles are placed near the tread and rim of the wheel. The coolant is administrated to the surfaces of the tread and rim of the wheel to achieve identical cooling rates equivalent to or higher than that of the graphite to ensure progressive solidification from the tread to the hub of the wheel. Since the expendable sand liner is molded for every wheel casting using a sand blower, the dimensional accuracy of wheel made using the present invention should be better than that made using graphite molds which suffer a gradual damage at the surfaces in contact with the high temperature molten steel.

Example 3

In the automotive industry, thin-walled large aluminum castings are usually made using the high pressure die casting (HPDC) process because the sand casting process is not capable of producing such castings. HPDC is also termed as die casting. During die casting, high pressures have to be used to inject molten aluminum at high speeds into the cavity in molds made of steel in order to be able to fill the entire die cavity [9-10]. Still, there is a limit on the size of a casting that the die casting is capable of making U.S. patent application Ser. No. 15874348 by Kailas of Tesla, Inc. discloses a giant die casting machine for the production of the entire body frame of a car in a single press. The body frame part may be the largest thin-walled aluminum casting to be made in the casting industry. The present invention shown in FIG. 4 provides a method and an apparatus for making castings such as the entire body frame of a car. The expendable liner provides the dimensional accuracy of the casting; the heated liner maintained at high temperatures allows a slow and smooth mold filling of the entire die cavity; and the embedded cooling nozzles allow a progressive solidification from the distal ends of the casting to the riser. It is expected that the body frame of a car made using the present invention should have much better internal integrity and mechanical properties than that made using the HPDC process. This is because 1) progressive solidification is not achievable for thin-walled castings solidifying in metal molds, and 2) entrapment of oxides and gases are unavoidable during die casting which is associated with a turbulent mold filling process. Furthermore, it is extremely expensive to build a giant die casting machine for the production of extremely large thin-walled castings.

Example 4

Because progressive solidification is not achievable in HPDC process, the industry has been using various means to achieve local progressive solidification using cooling lines in the metal mold or cooling pins. Cooling lines are drilled into a block of a metal die so the cooling lines are usually straight. The coolant, usually water or oil, is not in direct contact with the casting. Instead, it is only circulating in the cooling lines to take away heat from the die. To prevent damage to the expensive metal die, the cooling lines are usually drilled at least 10 mm away from the cavity surfaces. Heat extraction of these cooling lines from the solidifying casting is limited by the thermal diffusivity of the at least 10 mm thick steel. It is widely believed that the cooling lines are effective only in maintaining the dies at certain temperatures and are ineffective in reducing local solidification time in the casting. Cooling pins are more effective in achieving local progressive solidification in a casting. The cooling pins are made of metal and have coolant circulating within them as well. Still the chill effect of the cooling pins is limited by the thermal diffusivity of the metal separating the coolant from the casting, although the thickness of this metal layer becomes thinner using 3D printing technologies. By delivering a desired amount of a selected coolant through nozzles to contact the surfaces of the casting, more effective progressive solidification can be achieved at least locally using the present invention shown in FIG. 5 than that using cooling lines or cooling pins. The cooling nozzles can also be used to drive bubbles away from the surfaces to be machined as that the machined casting will be more pressure-tight and leak-tight [11].

Example 5

Figure 7:
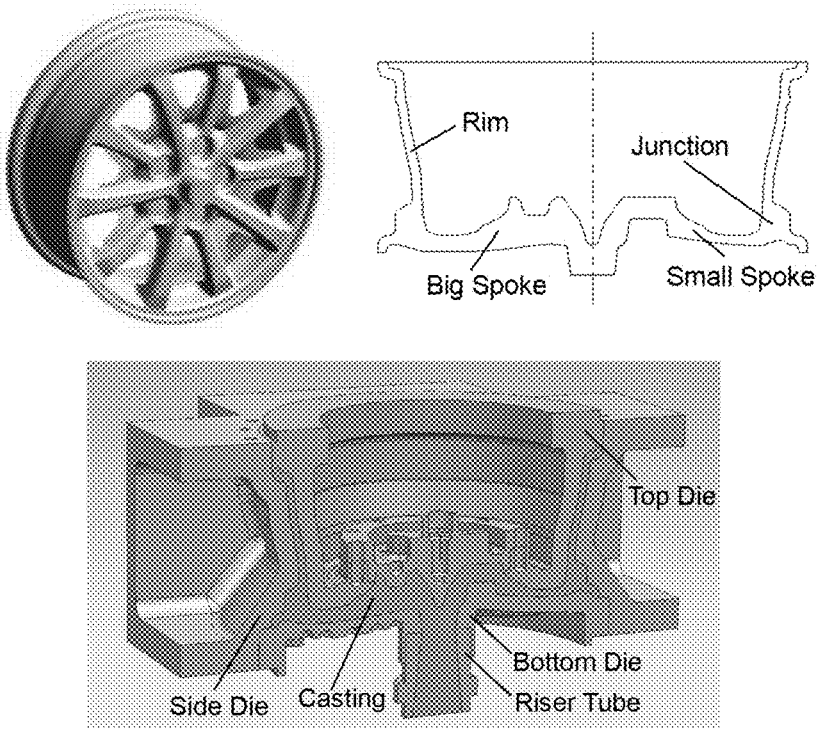
FIG. 7 shows a photograph of an aluminum wheel, a schematic side view of a layout of a prior art of making the cast wheel, simulated solidification times in the cast wheel made using a prior art, and a cross sectional view of the cast wheel.

Aluminum automotive wheels are made using permanent mold process. The molds are made of steel. A relative thick coating is applied on the mold surface to protect the mold steel from erosion during mold filling under low pressure or under gravity casting conditions. The use of a thick coating also slows down the flow speed of the metal during mold filling. A photograph of a wheel is shown at top left image in FIG. 7. The wheel casting is made using three molds: a top die, a bottom die, and a side die, and is fed from a riser tube shown at the top right image in FIG. 7. Numerical modeling [12] indicates that there are hot spots at the junctions between the spoke and the rim. These hot spots cannot be properly fed by the liquid metal through the big spoke from the riser tube shown in the bottom images in FIG. 7, leading to porosity formation in the junctions. By using an array of nozzles embedded in the side die which delivers a desired amount of a selected coolant to contact the surfaces of the casting near the junctions at desired times, the hot spots and the resultant porosity in the junctions can be minimized using the present invention shown in FIG. 3. In addition, the solidification time in the spoke area is a little too long. Long solidification times in the spoke regions limit the production rates of the wheels. A reduction of the solidification times in the spoke area would lead to significant cost savings. By using an array of nozzles embedded in the top die which delivers a desired amount of a selected coolant to contact the surfaces of the casting near the big spokes at desired times, the solidification times of the big spokes can be reduced using the present invention shown in FIG. 3.

While the invention has been described in connection with specific embodiments thereof, it will be understood that the inventive methodology is capable of further modifications. This patent application is intended to cover any variations, uses, or adaptations of the invention following, in general, the principles of the invention and including such departures from the present disclosure as come within known or customary practice within the art to which the invention pertains and as may be applied to the essential features herein before set forth and as follows in scope of the appended claims.

REFERENCES

1. J. Grassi, J. Campbell, M. Harlieb, and F. Major, "Ablation Casting," in *Aluminum Alloys: Fabrication, Characterization and Applications*, eds. W. Yin and S. K. Das, TMS (The Minerals, Metals & Materials Society) 2008, pp. 73-78.
2. J. Grassi, J. Campbell, M. Harlieb, and F. Major, "The Ablation Casting Process," *Materials Science Forum*, vols. 618-619, (2009), pp. 591-594.
3. K. Ho, R. D. Pehlke, "Metal-Mold Interfacial Heat Transfer," *Metallurgical Transaction B*, vol 16, (1985), pp. 585-594.
4. D. Sui, and Q. Han, "Effects of Different Parameters on Porosity Defects between the Horizontal and Vertical Shot Sleeve Processes," *International Journal of Metalcasting*, vol. 13 (2), 2019, pp. 417-425.
5. Q. Han, S. Viswanathan, "Analysis of the mechanisms of die soldering in aluminum die casting," *Metallurgical and Materials Transaction A*, vol. 34, (2003), pp. 139-146.
6. Q. Han, and S. Viswanathan, "The Use of Thermodynamic Simulation for the Selection of Hypoeutectic Aluminum-Silicon Alloys for Semi-solid Metal Processing," *Materials Science and Engineering A,* 364 (1-2), 2004, pp. 48-54.
7. American Brake Shoe, "Results of research: X-2 Wheels," *Railway Age, May* 2nd, 1955, pp. 60-64.
8. G. Qin, and J. Han, "Advancement of the Production Technology of Train Wheels," Shanghai Metals, vol. 21 (No. 4), 1999, pp. 58-60.
9. Q. Han, J. Zhang, "Fluidity of Alloys Under HPDC Conditions: Flow Choking Mechanisms," *Metallurgical and Materials Transaction B*, vol. 51, (2020), pp.
10. Q. Han, H. Xu, "Fluidity of Alloys under High Pressure Die Casting Conditions," *Scripta Materialia*, vol. 53, (2005), pp. 7-10.
11. Q. Han, "Motion of Bubbles in the Mushy Zone," Scripta Materialia, vol. 55, (2006), pp. 871-874.
12. D. Sui, Z. Cui, R. Wang, S. Hao, and Q. Han, "Effect of Cooling Process on Porosity in the Aluminum Alloy Automotive Wheel during Low-Pressure Die Casting," International Journal of Metalcasting, vol. 10 (2016), pp. 32-42.

What is claimed is:

1. A process for the casting of metals, comprising the steps of:

preparing at least an aggregate-containing mold with a cavity for castings and a plurality of through holes having cooling nozzles wherein the cooling nozzles are spaced at predetermined intervals and the at least aggregate-containing mold is held at predetermined temperatures to maintain an acceptable level of progressive solidification from a distal end of a casting to a riser or a downsprue;

placing a plurality of venting in the at least an aggregate-containing mold for releasing fluids;

embedding nozzles into the through holes in the at least an aggregate-containing mold;

introducing a molten metal into the mold cavity for forming castings;

delivering a predetermined amount of a selected coolant including water to the tip of each nozzle at predetermined rates, times, and durations to contact external surface of the casting and to directly cool the external surface of the casting in order to maintain an acceptable level of progressive solidification from the distal end of the casting to the riser or downsprue; and cooling the casting under control to predetermined temperatures before removing the casting out of the molds.

2. A process according to claim 1 wherein the mold includes at least one layer of coolant permeable materials composed of at least an aggregate and a binder.

3. A process according to claim 1 wherein the through holes in the at least an aggregate-containing molds for hosting nozzles are either directly molded in a molding machine or machined on the molds.

4. A process according to claim 1 where in the molten metal is introduced into the mold cavity by gravity or by pressure.

5. A process according to claim 1 wherein controllers are used to control the delivery of a predetermined amount of coolant to each embedded nozzle in the molds at predetermined rates, times, and durations.

6. A process according to claim 1 wherein the coolant further includes, a gas, a mixture of gases, or a mixture of liquids and gases that directly cool the external surface of the casting to achieve high cooling rates at regions of contact until the metal is cooled to predetermined temperatures.

7. A process of claim 1 wherein the venting comprises a venting system to release used coolant and resultant gases within the at least an aggregate-containing mold.

8. A process of claim 1 wherein the venting comprises a solid plug that can be removed out of the at least an aggregate-containing mold at predetermined times.

9. A process of claim 1 wherein the cavity for castings is made using molding methods, including machine molding, 3D printing, lost wax process or investment casting process, and lost foam process.

* * * * *